US006230588B1

(12) United States Patent
Ran

(10) Patent No.: US 6,230,588 B1
(45) **Date of Patent: *May 15, 2001**

(54) CAN OPENER

(76) Inventor: Yang Wan Ran, 4F, No. 8, Alley 10, Lane 305, Chung Ho Road, Yung Ho City Taipei Hsien (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/318,383

(22) Filed: May 25, 1999

Related U.S. Application Data

(63) Continuation of application No. 08/846,054, filed on Aug. 3, 1999, now Pat. No. 5,931,058.

(51) Int. Cl.[7] ..... B67B 7/00
(52) U.S. Cl. ..... 81/3.36; 81/3.15
(58) Field of Search ..... 81/3.15, 3.36, 81/3.55; 220/285

(56) References Cited

U.S. PATENT DOCUMENTS

| | | | | |
|---|---|---|---|---|
| 1,711,225 | * | 4/1929 | Crowell | 81/3.15 X |
| 1,759,020 | * | 5/1930 | Nornable | 220/285 |
| 1,955,750 | * | 4/1934 | Jones | 81/3.15 X |
| 2,054,897 | * | 9/1936 | Darling | 220/285 |
| 4,881,432 | * | 11/1989 | Olorenshaw et al. | 81/3.36 |
| 5,295,419 | * | 3/1994 | Denning | 81/3.55 X |

FOREIGN PATENT DOCUMENTS

| | | | | |
|---|---|---|---|---|
| 540799 | * | 2/1957 | (IT) | 81/3.15 |

* cited by examiner

*Primary Examiner*—James G. Smith
(74) *Attorney, Agent, or Firm*—Knobbe, Martens, Olson & Bear, LLP

(57) ABSTRACT

A can opener used with a can having an operating rim and an opening to be covered in an air-tight manner by a cover having an operating flange includes an operating medium for being operated against the operating flange to open the can covered in the air-tight manner by the cover, and an attaching medium secured to the can for always attaching thereto the operating medium in a position ready for opening the can.

12 Claims, 8 Drawing Sheets

CAN OPENER

This application is a continuation of U.S. Pat. No. 08/846,054, issued Aug. 3, 1999, Ser. No. 5,931,058.

FIELD OF THE INVENTION

The present invention relates to an opener, and more particularly to a can opener.

BACKGROUND OF THE INVENTION

As shown in FIGS. 1A & 1B, the can, which is often made of tin, generally includes a can body 2, 2' having an operating top rim 21, 21' and a central top opening to be covered in an air-tight manner by a cover 1 having an operating top flange 11 for storing therein powdered milk, biscuit, cracker . . . or the like. Since top flange 11 is small and held extremely adjacent to can body 2, 2', it is always necessary to open the can with screwdriver, spoon, a pair of scissors . . . or the like which is, however, dangerous and/or inconvenient to the user troubled to find it out from somewhere. Certainly, it can be found there also is someone who is unwilling to be so troubled and thus does not want to airtightly utilize cover 1 which, certainly, is not a good way to use the can.

SUMMARY OF THE INVENTION

It is therefore an object of the present invention to provide a can opener. It is therefore another object of the present invention to provide a safe and/or convenient can opener.

According to the present invention, a can opener adapted to be used with a can having an operating rim and an opening to be covered in an air-tight manner by a cover having an operating flange includes an operating medium for being operated against the operating flange to open the can covered in the air-tight manner by the cover, and an attaching medium secured to the can for always attaching thereto the operating medium in a position ready for opening the can.

Certainly, the operating rim integrally forms thereto a top flange, the attaching medium can be secured to the can by means of welding, clipping, magnet or adhesive, the rim can form a fulcrum for the operating medium, the attaching medium can be a flat plate, and the operating medium can be a bent strip, in which there is a distance between the rim and a point where the operating medium is bent.

Preferably the present can opener further includes an elastic member mounted between the operating medium and the can for always urging the operating medium in the ready position, in which the elastic member can be spring or elastic plate.

Preferably the operating medium has a lug, and the attaching medium has a retainer for retaining therein the lug, and the retainer preferably pivotally retains therein the lug. Alternatively, the retainer can be a spirally coiled end extended from the attaching medium.

Preferably the operating medium has another lug and the attaching medium has another retainer for retaining therein the another lug. Alternatively the attaching medium can have an upper opening and the operating medium can have a side lug for preventing the operating medium from escaping from the attaching medium.

Alternatively the attaching medium can have a holed upper portion to be elastic, and the operating medium can have a lug extension for deforming the upper portion when operated to open the can.

Certainly the attaching medium can have a bent extension for engaging with the rim.

According to another aspect of the present invention, a can opener used with a can having an operating rim and an opening to be covered in an air-tight manner by a cover having an operating flange includes an operating medium for being operated against the operating flange to open the can covered in the air-tight manner by the cover, an attaching medium secured to the can for always attaching thereto the operating medium, and an elastic member mounted between the operating medium and the can for urging the operating medium in a position ready for opening the can.

Certainly the attaching medium can further include a wire for fastening thereto the operating medium.

According to a further aspect of the present invention, a can opener used with a can having an operating rim and an opening to be covered in an air-tight manner by a cover having an operating flange includes an operating medium for being operated against the operating flange to open the can covered in the air-tight manner by the cover, an attaching medium secured to the can for always attaching thereto the operating medium, and an elastic member mounted between the operating medium and the attaching medium for urging the operating medium in a position ready for opening the can.

Certainly, the elastic member is an elastic wire.

The present invention may best be understood through the following descriptions with reference to the accompanying drawings, in which:

DETAILED DESCRIPTION OF THE PREFERRED EMBODIMENT

Figure 1B:
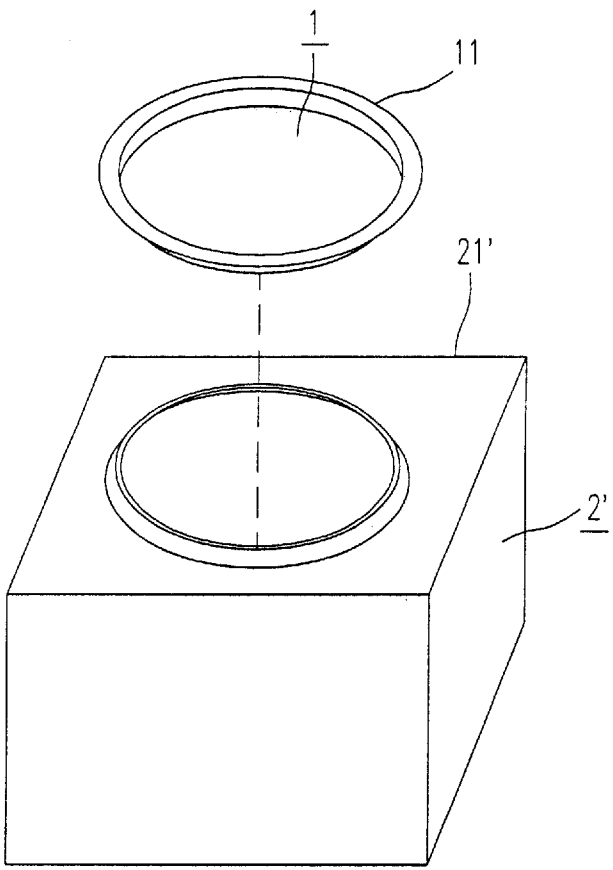
FIGS. 1A & 1B are schematical exploded views of cans.
Figure 1A:
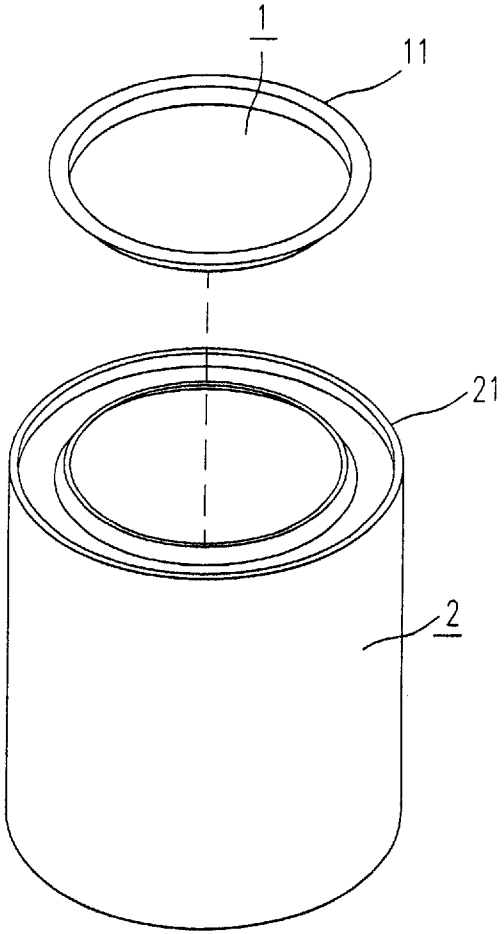
Figure 2A:
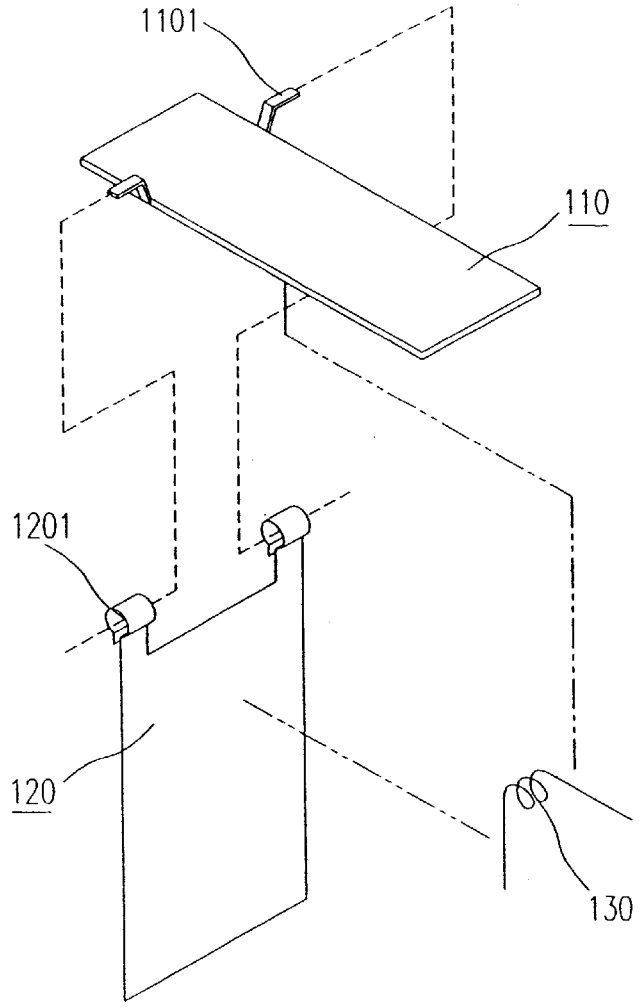
FIGS. 2A & 2B are respectively exploded and assembled views of a first preferred embodiment of a can opener according to the present invention, FIGS. 3A, 3B & 3C respectively schematically show how the present can opener is assembled to a can, how the present can opener functions with a can, and the force diagram occurred with respect to the present can opener.
Figure 2B:
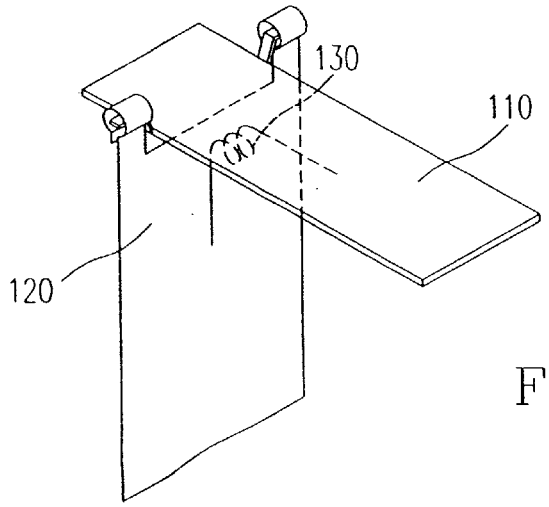

Referring now to FIGS. 2A & 2B, there are respectively shown an exploded and an assembled views of a first preferred embodiment of a can opener according to the present invention. The present can opener to be used with a can having an operating top rim 21, 21' in the form of a flange and an opening to be covered in an air-tight manner by a cover 1 having an operating top flange 11 includes an operating medium 110 having two side lugs 1101 for being operated against operating flange 11 to open the can covered in the air-tight manner by cover 1, an attaching medium 120 secured to the can and having two top retainers 1201 for respectively retaining therein side lugs 1101, and an elastic member 130 being a spring or an elastic plate mounted between operating and attaching media 110 and 120 for always urging operating medium 110 in a position ready for opening the can.

Figure 3A:
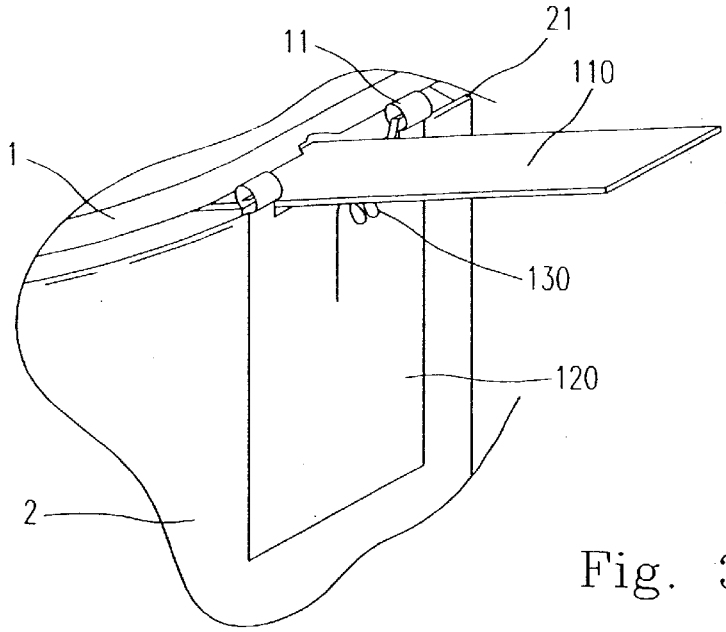
Figure 3B:
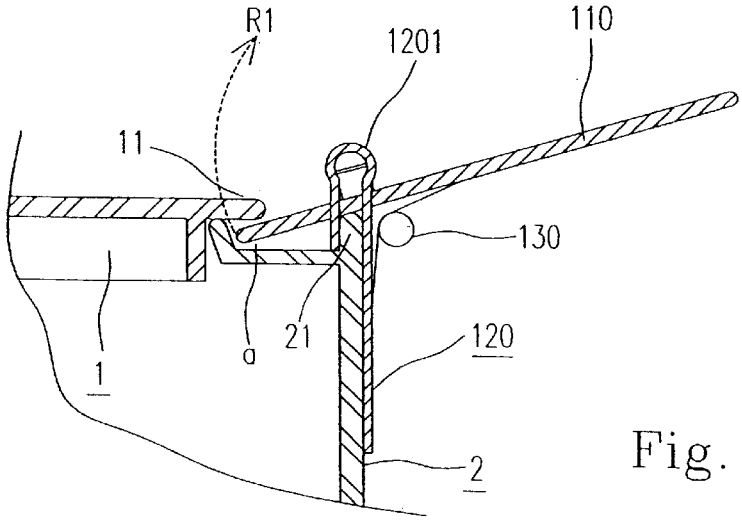
Figure 3C:
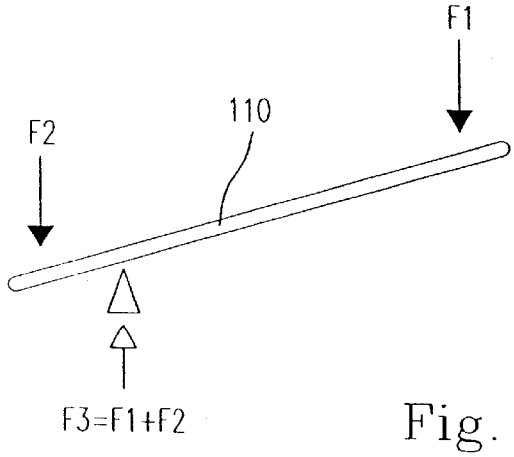

As shown in FIGS. 3A, 3B & 3C which respectively schematically show how the present can opener is assembled to a can, how the present can opener functions with a can, and the force diagram occurred with respect to the present can opener, attaching medium 120 can be secured to the can by means of welding, clipping, magnet, adhesive or any other suitable way and operating medium 110 has one end a protruding beyond top rim 21 and positioned under top flange 11. When the other end of operating medium 110 is downwardly force-applied, the top rim or flange 21, 21' will form a fulcrum for operating medium 110 in order that end a of operating medium 110 will upwardly urge top flange 11 to open cover 1 and that spring 130 will be compressed. When operating medium 110 is no more force-applied, spring 130 will restore operating medium 110 to a position ready for operation again which means that end a will be returned to the place under top flange 11 without interfering one's covering can body 2, 2' with cover 1. Since the fulcrum must support a force F3 being the sum of the downward foreign force F1 and the reactive force F2 generated by top flange 11, and thus being substantial, it is preferable that top flange 21, 21' is higher than a middle top edge of attaching medium 120 so that top flange 21, 21' can serve as the operating fulcrum of operating medium 110 in order that it is unnecessary to provide a robust attachment between attaching medium 120 and can body 2, 2'. Preferably lugs 1101 are offset from operating medium 110 as shown in order that operating medium 110 can easily have top flange 21, 21' serving as its fulcrum.

Figure 4A:
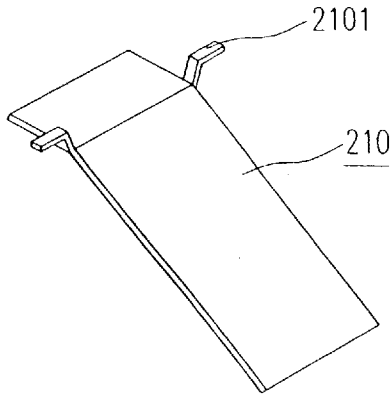
FIGS. 4A, 4B & 4C respectively show an operating medium of a can opener according to a second preferred embodiment of the present invention, its assembled perspective view and how it functions with a can.
Figure 4B:
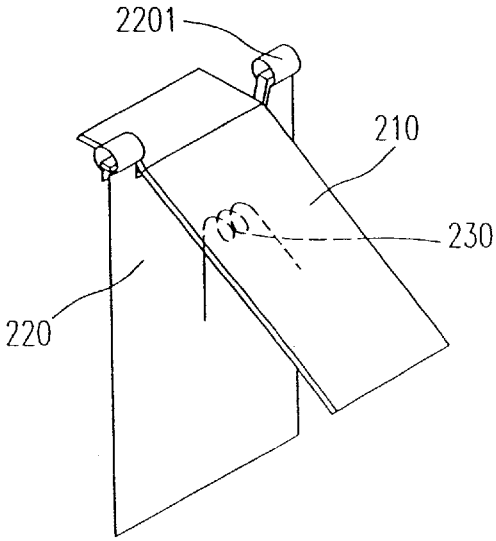
Figure 4C:
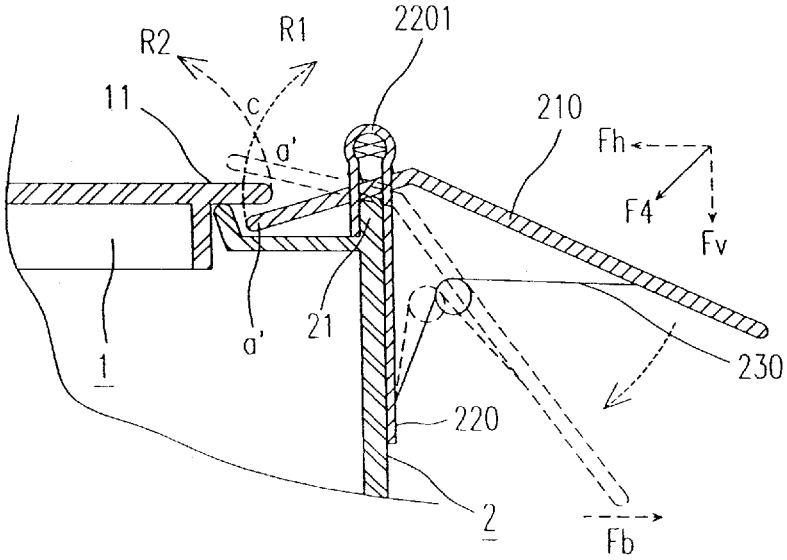

Referring now to FIGS. 4A, 4B & 4C which respectively show an operating medium of a can opener according to a second preferred embodiment of the present invention, its assembled perspective view and how it functions with a can, the present can opener can alternatively include an operating medium 210 being a bent strip and having offset lugs 2101 loosely received in top retainers 2201 in order to cope with a horizontal movement later described, an attaching medium 220 being a flat plate, and a spring 230. When a foreign force F4 is applied to operating medium 210, a horizontal component Fh will slightly move end a' toward cover 1. For permitting this horizontal movement, there is a distance between the top flange 21, 21' and the point where operating medium 210 is bent. Please refer to FIG. 4C, R1 denotes the trajectory of end a' of operating medium 210 without horizontal movement when operated and R2 denotes the trajectory of top flange 11 when uncovered where the intersection c of trajectories R1 and R2 denotes where end a' will disengage from and urge against no more top flange 11 which can be alleviated or overcome by the horizontal movement. Certainly, the reactive force Fb stored in spring 230 when operating medium 210 is operated will restore operating medium 210 to a position ready for operation again which means that end a' will be returned to the place under top flange 11 without interfering one's covering can body 2, 2' with cover 1.

Figure 5A:
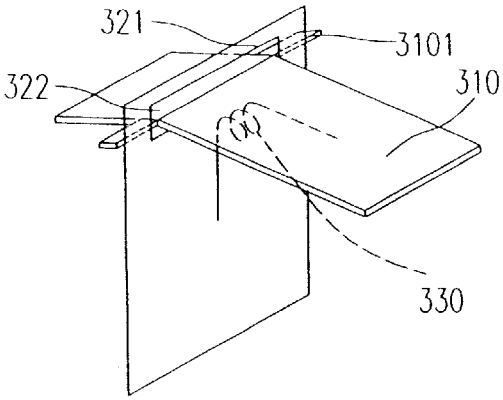
FIGS. 5A, 5B & 5C respectively schematically show a fractional perspective view of a can opener according to a third preferred embodiment of the present invention, the state it is assembled to a can and how it functions with a can.
Figure 5B:
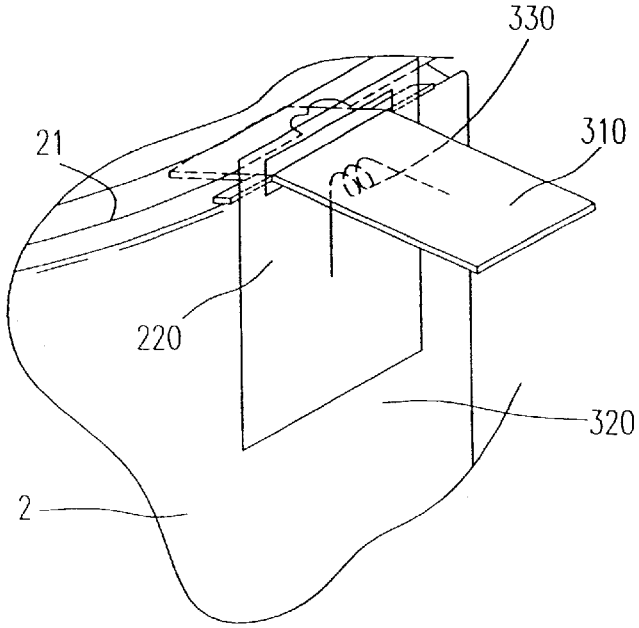
Figure 5C:
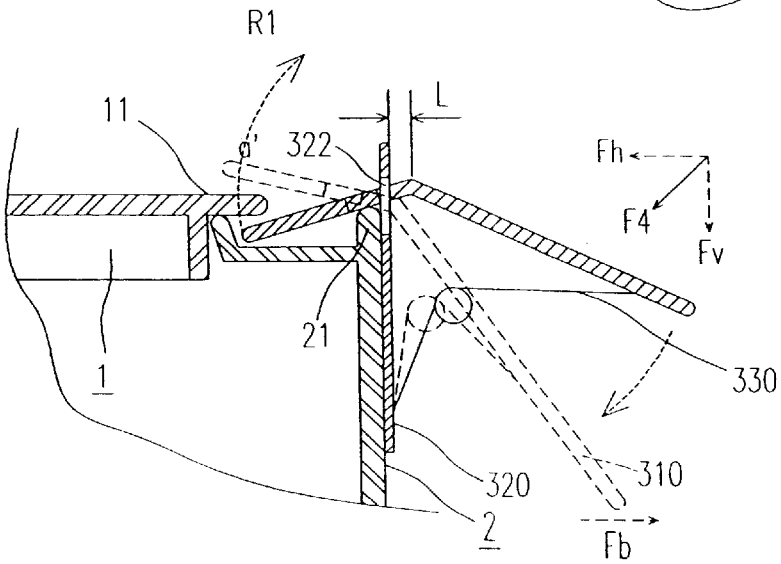
Figure 6A:
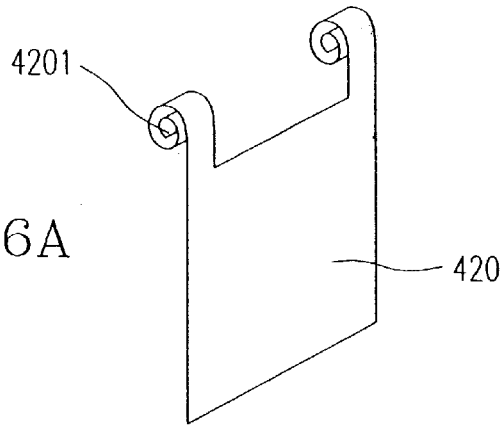
FIGS. 6A, 6B, 6C & 6D respectively schematically show an attaching medium of a can opener according to a fourth embodiment of the present invention, how its operating medium engages with its attaching medium, the state it is assembled to a can and how it functions with a can.
Figure 6B:
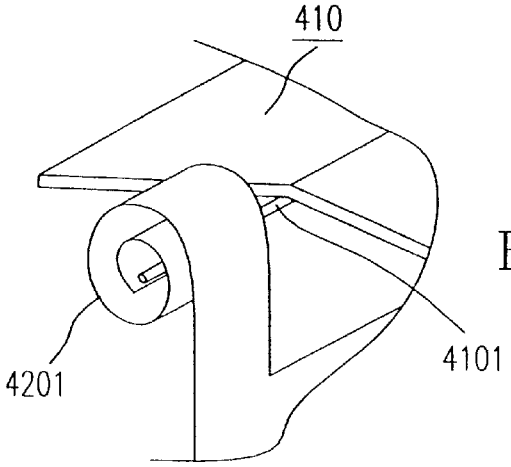
Figure 6C:
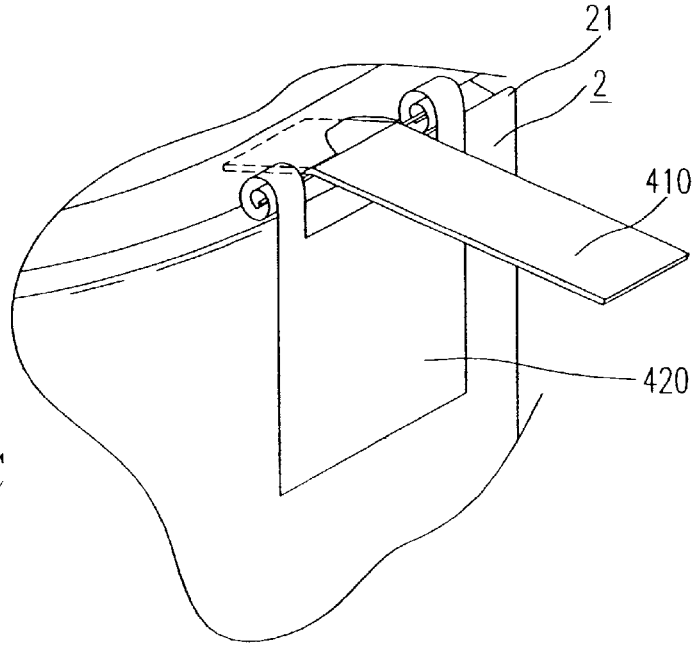
Figure 6D:
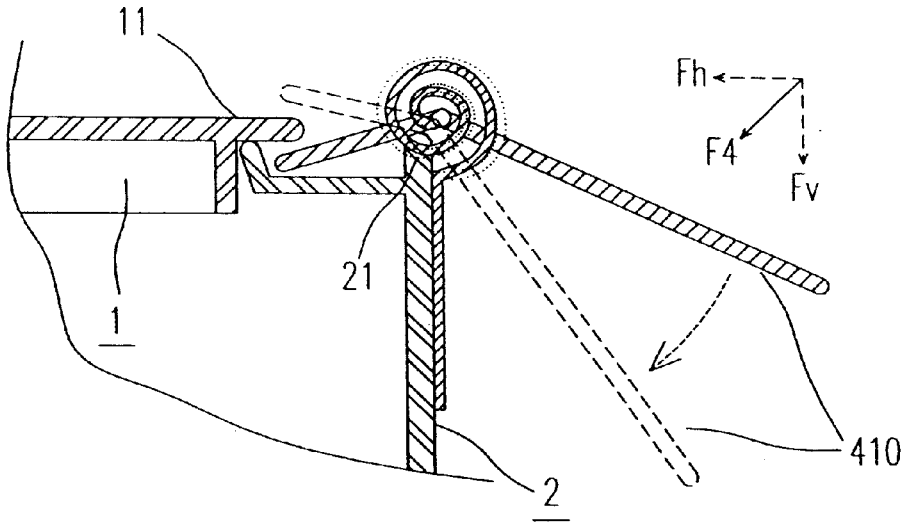

Referring now to FIGS. 5A, 5B & 5C which respectively schematically show a fractional perspective view of a can opener according to a third preferred embodiment of the present invention, the state it is assembled to a can and how it functions with a can, the present can opener includes an operating medium 310 having two side lugs 3101, an attaching medium 320 having an upper portion 321 having a through hole 322 capable of preventing operating medium 310 having side lugs 3101 from inadvertently backwardly escaping from attaching medium 320, and a spring 330. As can be seen in these drawings, the distance L between the top flange 21 (21') and the point where operating medium 310 is bent permits the forward movement of operating medium 310 as described in the preceding embodiment. Through hole 322 has a lower defining side lower than top flange 21, 21' in order that operating medium 310 can have a fulcrum on top flange 21, 21'.

Please refer to FIGS. 6A, 6B, 6C & 6D which respectively schematically show an attaching medium of a can opener according to a fourth embodiment of the present invention, how its operating medium engages with its attaching medium, the state it is assembled to a can and how it functions with a can. The present can opener includes an operating medium 410 having side lugs 4101, and an attaching medium 420 having two upper retainers 4201 being spirally coiled ends extended therefrom and respectively fixing thereto lugs 4101. Spirally coiled ends 4201 being elastic will restore operating medium 410 to its original position ready for operation when the foreign force disappears. Since coiled ends 4201 are deformable, they can allow the forward movement of operating medium 410 when operated.

Figure 7:
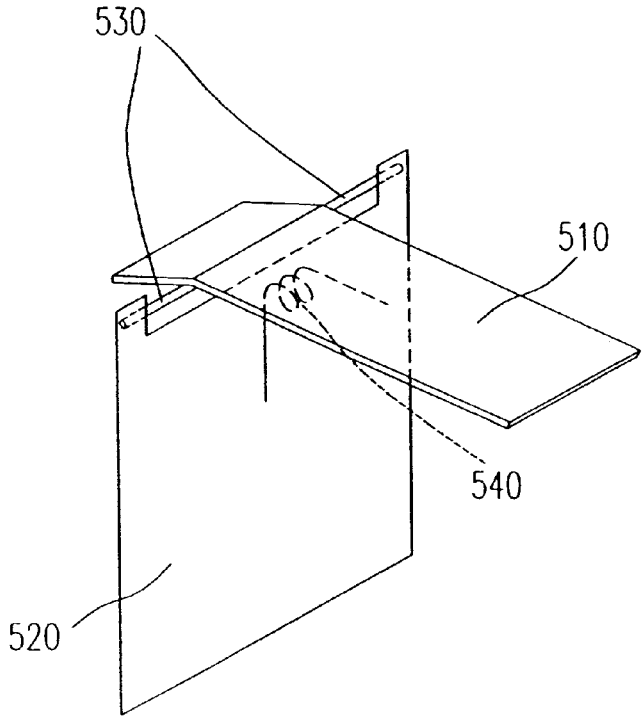
FIG. 7 shows a perspective view of a can opener according to a fifth embodiment of the present invention.

As shown in FIG. 7 which shows a perspective view of a can opener according to a fifth embodiment of the present invention, the present invention can alternatively include an operating medium 510, an attaching medium 520, a wire 530 connecting together media 510 & 520, and a spring 540. Since the connecting medium 530 is a wire, operating medium 510 is slightly translatable either horizontally or vertically for permitting the forward movement of operating medium 510 engageable with top flange 21, 21' also serving as a fulcrum thereof when operated. Alternatively, if connecting medium 530 is designed to be elastic, spring 540 can be dispensed with.

Figure 8A:
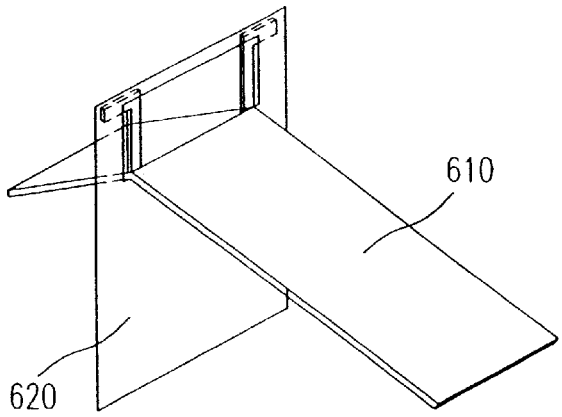
FIGS. 8A, 8B & 8C respectively show a perspective view, an operating state and an exploded view of a can opener according to a sixth embodiment of the present invention.
Figure 8B:
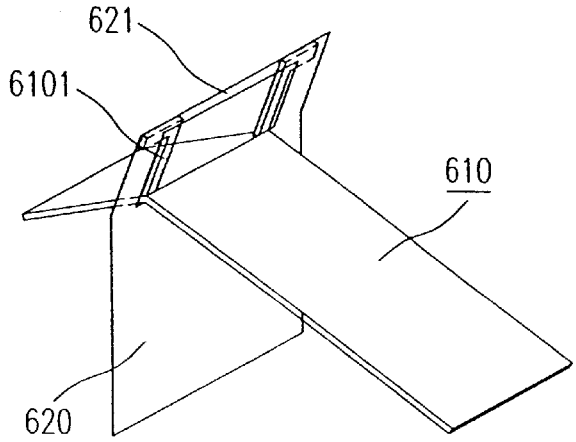
Figure 8C:
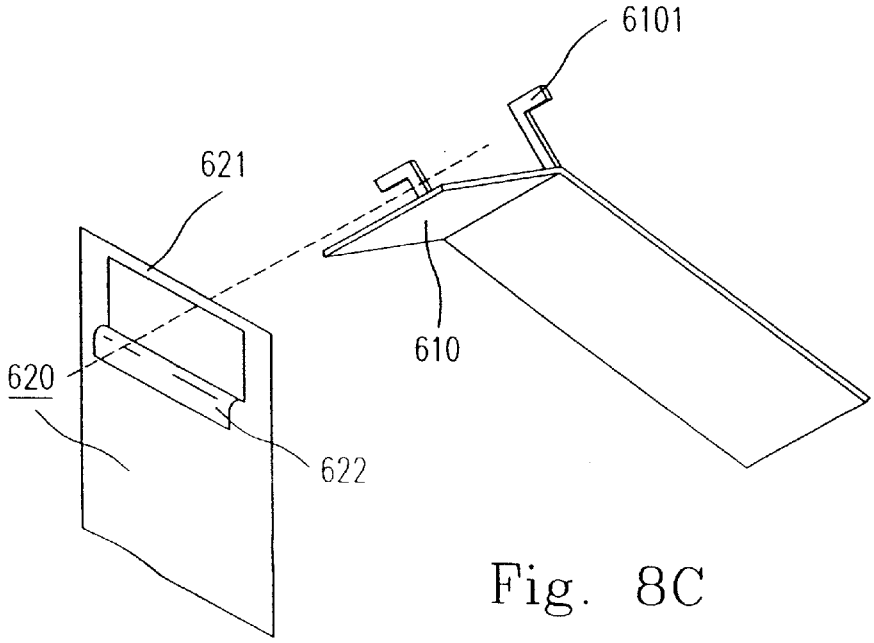

Referring now to FIGS. 8A, 8B & 8C which respectively show a perspective view, an operating state and an exploded view of a can opener according to a sixth embodiment of the present invention, the present can opener includes an operating medium 610 having offset lugs 6101, and an attaching medium 620 having a holed upper portion 621 being thus elastic and deformable by lug extensions 6101 when operating medium 610 is operated to open the can and a bent extension 622 for clipping thereto top flange 21 (21') so that no additional medium for fastening attaching medium 620 to can body 2 (2') is necessary.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A can opener adapted to be used with a can having an operating rim and an opening to be covered by a cover having an operating flange, comprising:

an operating medium having a lug positioned across said operating rim for being operated against said operating flange to open said can; and an attaching medium having a retainer for retaining therein said lug and so connected to said operating medium that when said attaching medium is secured to said can in a position ready for opening said can, said operating medium is in a position ready an elastic member mounted between said operating medium and said attaching medium for always urging said operating medium into said ready position, wherein said operating rim forms a fulcrum for said operating medium when said can opener is secured to said can.

2. A can opener according to claim 2, wherein said operating rim integrally forms thereon a top flange sp that when said attaching medium is attached to said can then said operating medium is positioned relative to said top flange to pivot about said top flange.

3. A can opener according to claim 1, wherein said attaching medium is a flat plate.

4. A can opener according to claim 1, wherein said attaching medium is a bent strip.

5. A can opener according to claim 1, wherein there is a distance between said rim and a point where said operating medium is bent.

6. A can opener according to claim 1, wherein said elastic member comprises one of a spring and elastic plate.

7. A can opener according to claim 1, wherein said retainer pivotally retains therein said lug.

8. A can opener according to claim 1, wherein said operating medium has another lug and said attaching medium has another retainer for retaining therein said another lug.

9. A can opener according to claim 1, wherein said attaching medium has a bent extension for engaging with said rim.

10. A can opener according to claim 1, wherein said operating medium has one end protruding beyond said top rim and positioned under said top flange.

11. A can opener according to claim 1, wherein said attaching medium is secured to said can by means of one selected from a group consisting of welding, clipping, magnet, and adhesive.

12. A can with a can opener, comprising:

a can having an operating rim and an opening to be covered by a cover having an operating flange;

an operating medium positioned across said operating rim for being operated against said operating flange to open said can;

an attaching medium so connected to said operating medium that when said attaching medium is secured to said can in a position ready for opening said can, said operating medium is in a position ready for opening said can; and an elastic wire mounted between said operating medium and said attaching medium for urging said operating medium into said position ready for opening said can.

* * * * *

UNITED STATES PATENT AND TRADEMARK OFFICE

CERTIFICATE OF CORRECTION

PATENT NO. : 6,230,588 B1
DATED : May 15, 2001
INVENTOR(S) : Yang Wan Ran

It is certified that error appears in the above-identified patent and that said Letters Patent is hereby corrected as shown below:

Column 5,
Line 8, after the word "ready", please add -- for opening said can; and --;
Line 15, please change "Claim 2" to -- Claim 1 --;
Line 16, please change "sp" to -- so --.

Signed and Sealed this

Second Day of July, 2002

*Attest:*

*Attesting Officer*

JAMES E. ROGAN
*Director of the United States Patent and Trademark Office*